United States Patent [19]

Van Laer

[11] 4,412,619

[45] Nov. 1, 1983

[54] RECLOSABLE CARRY-CARTON

[75] Inventor: Albert Van Laer, Beveren-Melsele, Belgium

[73] Assignee: The Procter & Gamble Company, Cincinnati, Ohio

[21] Appl. No.: 342,340

[22] Filed: Jan. 25, 1982

[30] Foreign Application Priority Data

Jun. 17, 1980 [GB] United Kingdom ..... 80-19681

[51] Int. Cl.[3] ..... B65D 27/38

[52] U.S. Cl. ..... 206/611; 206/621; 229/52 B

[58] Field of Search ..... 206/611, 621, 806, 622, 206/624, 625, 626; 229/52 B

[56] References Cited

U.S. PATENT DOCUMENTS

| | | | |
|---|---|---|---|
| 3,507,442 | 4/1970 | Van Dam et al. | 229/52 B |
| 3,595,466 | 7/1971 | Rosenburg, Jr. | 206/626 |
| 4,106,615 | 8/1978 | Hiroshi | 206/806 |
| 4,201,292 | 5/1980 | Davidson et al. | 206/621 |
| 4,344,533 | 8/1982 | Olsen | 206/621 |

*Primary Examiner*—Steven M. Pollard
*Assistant Examiner*—David Voorhees
*Attorney, Agent, or Firm*—Richard C. Witte; John V. Gorman; Thomas H. O'Flaherty

[57] ABSTRACT

Reclosable carry-carton with integrated handle formed from a one piece carton blank of which the upright back top panel and the extension flap which is articulated from the distal end of the outer top panel coincide with each other when the carton is erected and closed and which both present a hand hold cut-out in registry with one another which form the carrying means. A tear strip located above the score line attaching the extension flap to the outer top flap and underneath the cut-out and extending over the whole width of the extension flap allows opening of the carton. The portion of the extension flap underneath the tear strip which is freed once the tear strip is removed allows easy opening by pulling of the top of the carton and can be folded over and tucked inside the carton when it has to be reclosed.

2 Claims, 10 Drawing Figures

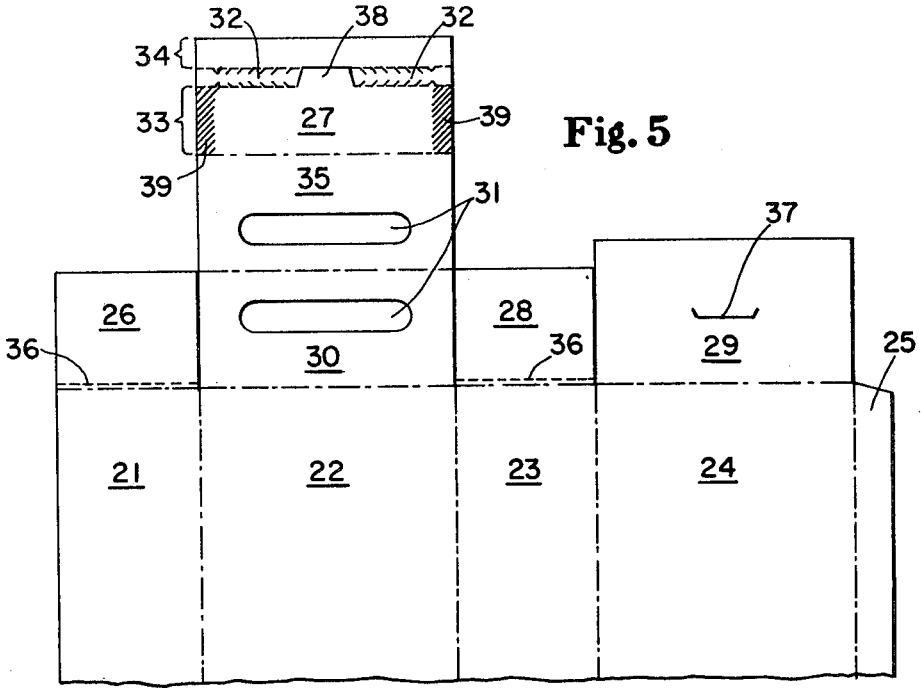
Fig. 5
Fig. 6
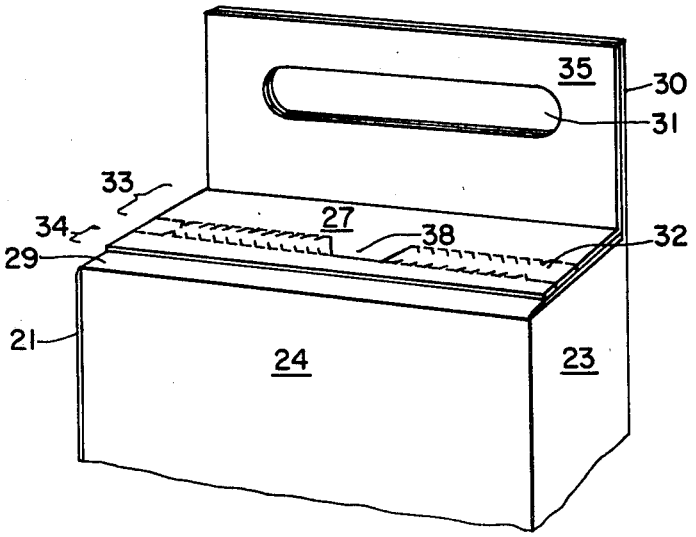

RECLOSABLE CARRY-CARTON

TECHNICAL FIELD

The invention described herein relates to a carton which can be carried by an integrated handle when closed and which, after having been opened, is reclosable and remains closed when carried by the integrated handle after opening.

BACKGROUND OF THE INVENTION

For the sake of economy, detergent products are frequently sold in bulk size containers, be it drums or cartons. Since the contents of such containers last for quite a while, it is important for the user, who is frequently a housewife, that the container be easy to handle and that its contents can be properly protected by an appropriate closing means which is, ideally, attached to the container so that it does not get lost, be misplaced or fall off.

From the standpoint of the manufacturer, it is important that, in meeting the user's needs, a solution is found which does not increase the cost in raw material or in manufacturing, filling or closing, to an unacceptable extent. Ideally, a solution should be found which decreases the cost of the existing containers.

Rectangular containers, which take least storage space before filling, during shipping, and in the trade, are well known in the art. Such rectangular containers equipped with an integrated handle are also well known and are generally referred to as carry-cartons. However, none of the known carry-cartons with integrated handle is equipped with a reclosing device which does not open through the weight traction of the contents of the carton when said carton is carried by its integrated handle after opening.

It is, therefore, an object of the present invention to form a carry-carton with an integrated handle, which is reclosable after opening and which remains closed when carried without an undue increase in cost versus presently used carry-cartons.

SUMMARY OF THE INVENTION

The present invention pertains to a reclosable carry-carton with integrated handle which is formed from a one piece carton blank of which the upright back top panel and the extension flap which is articulated from the distal end of the outer top panel coincide with each other when the carton is erected and closed and which both present a hand hold cut-out in registry with one another which form a carrying means. A tear strip located above the score line attaching the extension flap to the outer top flap and underneath the cut-out and extending over the whole width of the extension flap allows opening of the carton. The portion of the extension flap underneath the tear strip is freed once the tear strip is removed. This portion allows easy opening by pulling of the top of the carton and can be folded over and tucked inside the carton against its back wall when the carton has to be reclosed.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in connection with the accompanying drawings in which:

FIG. 5 is a plan view of the upper part of a carton blank from which another version of a reclosable carry-carton is formed.

FIG. 6 is a perspective view of the top part of the version of the reclosable carry-carton of FIG. 5 in its erected and closed position after the carton has been filled.

DETAILED DESCRIPTION OF THE INVENTION

Figure 1:
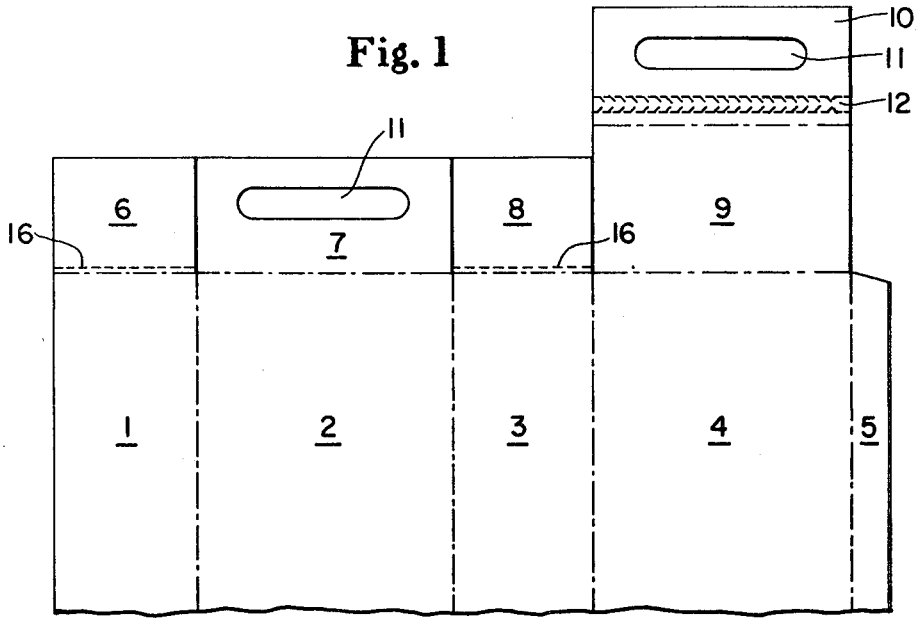
FIG. 1 is a plan view of the upper part of a carton board blank from which the most preferred embodiment of a reclosable carry-carton of the present invention is formed.

The partial carton blank illustrated in FIG. 1 consists of side panels 1, and 3 and face panels 2 and 4 as well as of the sealing strip 5. Top flaps 6, 7, 8 and 9 are integrally attached along score lines to the top edge of the respective side and face panels 1, 2, 3 and 4. Extension flap 10 is integrally attached along a second score line to the distal edge of outer top flap 9. Hand hold cut-outs are foreseen in upright back top flap 7 and extension flap 10. Extension flap 10 is equipped with a tear strip 12 intermediate the hand hold cut-out 11 and said second score line attaching the extension flap 10 to the outer top flap 9, and spaced from said second score line. Inner top flaps 6 and 8 are equipped with lines of weakness 16.

Figure 2:
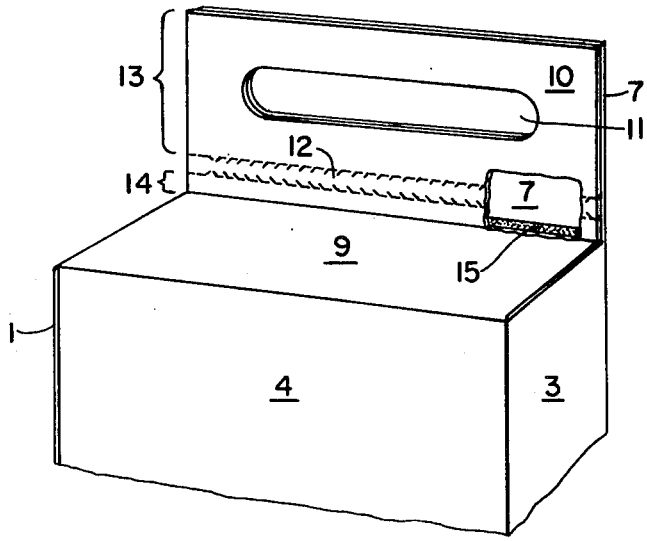
FIG. 2 is a perspective view showing the top part of the reclosable carry-carton illustrated in FIG. 1 in its erected and closed position after the carton has been filled.

The partial carry-carton illustrated in FIG. 2 shows the carton blank of FIG. 1 in its erected and closed position. The carton is erected in a conventional way, i.e. the side and face panels are assembled by sealing strip 5 on panel 1, the bottom flaps (not shown) are assembled and glued in a conventional way. After filling, inner top flaps 6 and 8 are folded inwards horizontally and subsequently the inner surface of outer top flap 9 is adhesively joined to the outer surfaces of inner top flaps 6 and 8, whereas upright back top flap 7 remains upright. Subsequently, extension flap 10 is folded back by 90° and the portion 13 of extension flap 10 is glued against the upright back top flap 7 in such a way that the hand hold cut-outs 11 are in registry. Portion 14 of extension flap 10 as well as the tear strip remain substantially free of glue.

Glue line 15 along the full width of extension flap 10 (partially broken away) at the point where said extension flap 10 is folded against upright back top flap 7 is foreseen if the carry-carton contains a product which could shift out of the carton before it has been opened.

Figure 3:
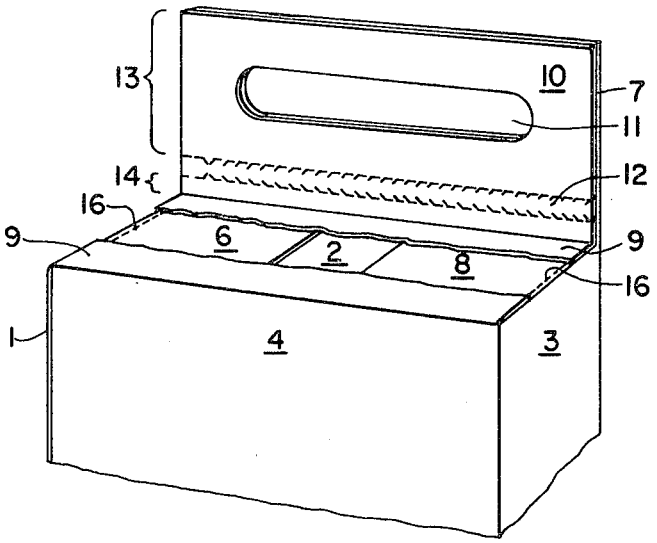
FIG. 3 is a perspective view showing the carton illustrated in FIG. 2 but with the upper layer of the top side removed to show the underlying structure.

The partial carry-carton illustrated in FIG. 3 shows the carton of FIG. 2 but with outer top flap 9 partially broken away so that the position of lines of weakness 16 can clearly be seen. As will be appreciated by those skilled in the art, these lines of weakness can be provided in several ways, i.e. by cutting partway through the thickness of the carton board, by providing a line of perforations, etc.

Figure 4:
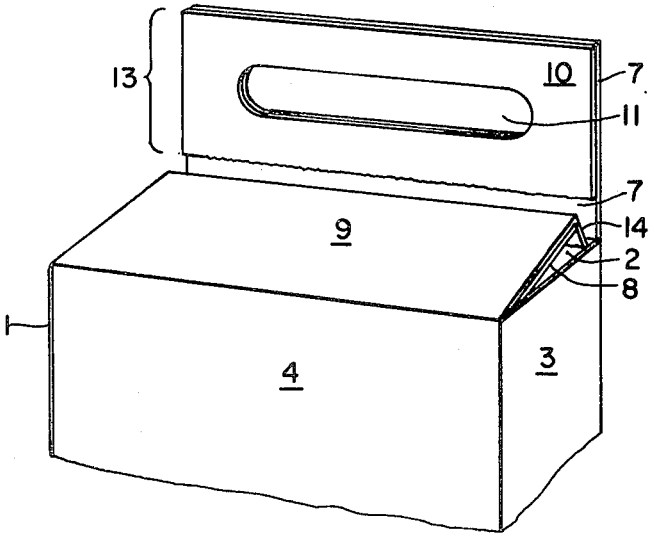
FIG. 4 is a perspective view showing the carton illustrated in FIG. 2 in its reclosing function after having been opened.

The partial carry carton illustrated in FIG. 4 shows the carton of FIG. 2 being reclosed after having been opened by removal of tear strip 12. Since portion 14 of extension flap 10 remains substantially free of glue, this gives an easy grasp to tear the flap 9 open. If the slight line of glue 15 (shown in FIG. 2) is provided because of the possible risk of sifting of the contents of the carry-carton, this will easily be detached when pulling on portion 14. Further pulling will break the lines of weakness 16 of inner top flaps 6 and 8 so that said top flaps remain attached to the underside of outer top flap 9, giving thereby access to the contents of the carry-carton. To reclose the carton, section 14 is folded back by 180° and tucked inside the carry-carton to come to rest against the inside of face panel 2. The so reclosed carton will remain closed, even when carried by its integrated handle, since no traction is exerted on the cover.

The partial carton blank illustrated in FIG. 5 shows another execution of a reclosable carry-carton and consists of 4 side panels 21, 22, 23 and 24 as well as of the seal strip 25. Top flaps 26, 28 and 29 are integrally attached along score lines to the top edge of the respective side panels 21, 23 and 24 respectively. Top flaps 26 and 28 are equipped with weaking lines 36. Extension 30 is integrally attached along a score line to the top edge of side panel 22. Extension 35 is integrally attached along a score line to the top edge of extension 30. Cut-outs 31 are foreseen in extensions 30 and 35. Top flap 27 is integrally attached along a score line to the top edge of extension 35. Top flap 27 is equipped with a tear strip 32. In top flap 29, a slot 37 is partially pre-cut. In top flap 27, a lug 38, dimensioned to fit into slot 37, is pre-cut in the center of tear strip 32.

The partial carry-carton illustrated in FIG. 6 shows the carton blank of FIG. 5 in its erected and closed position. The carton is erected in a conventional way, i.e. the side panels are assembled by a seal strip 25 on panel 21, the bottom flaps (not shown) are assembled and glued in a conventional way. After filling, top flaps 26 and 28 are folded inwards horizontally and susequently top flap 29 is glued over top flaps 26 and 28. Subsequently, extension 35 is folded over by 180° towards top flap 29 in such a way that the cut-outs 31 of extensions 30 and 35 coincide, and is glued against extension 30. Subsequently, top flap 27 is glued over top flap 29 with glue being provided only on portion 34 and along hatched lines 39 of portion 33. For this purpose, a glue is used which releases when traction is exerted on portion 33 of top flap 27.

Figure 7:
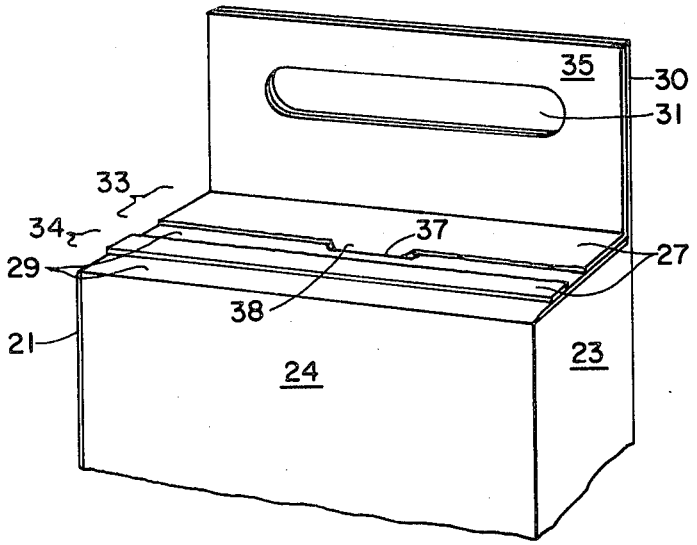
FIG. 7 is a perspective view showing the carton illustrated in FIG. 6 in its reclosing function after having been opened.

The partial carry-carton illustrated in FIG. 7 shows the carton of FIG. 6 after tear strip 32 has been removed, the carton has been opened and subsequently reclosed. Since portion 33 of top flap 27 is glued on both sides only along hatched lines 39 (shown in FIG. 5) with a releasable glue and since lug 38 remains substantially free of glue, an easy grasp is given to open top flap 27. This then gives easy access to open top flap 29 which, upon pulling, causes weakening lines 36 to rupture so that top flaps 26 and 28 remain attached to the underside of top flap 29, giving thereby access to the contents of the carry-carton. To reclose the carton, lug 38 of top flap 27 is tucked inside slot 37 of top flap 29. This will ensure that the carton remains closed, even when carried by its integrated handle. If desirable, several coinciding lugs 38 and slots 37 can be foreseen.

Figure 8:
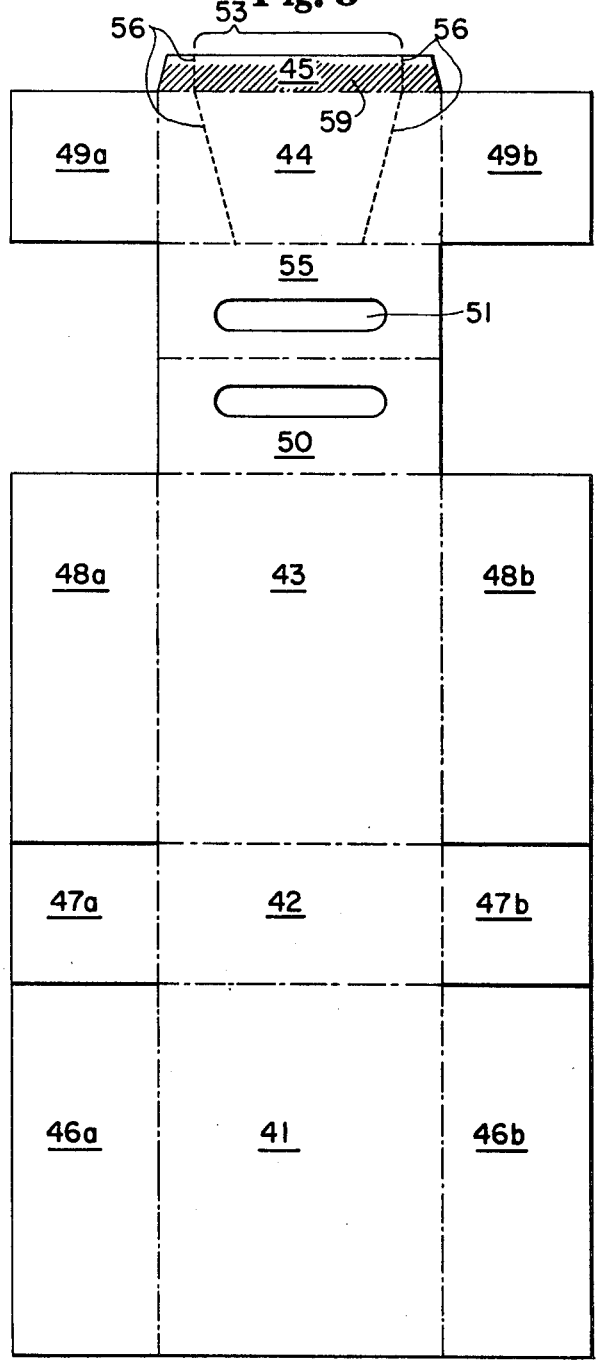
FIG. 8 is a plan view of a carton board blank from which still another version of a reclosable carry-carton is formed.

The carton blank illustrated in FIG. 8 shows still another execution of a reclosable carry-carton. It differs from the previous versions in that the carton is filled through a side panel after partial erection of the blank. It consists of front panel 41, bottom panel 42, back panel 43 and top panel 44. Integrally attached between back panel 43 and top panel 44 are extensions 50 and 55. Cut-outs 31 are foreseen in extensions 50 and 55. Side flaps **46*a-b*, 47*a-b*, 48*a-b* and 49*a-b* are integrally attached along the side edges of the respective panels 41, 42, 43 and 44. Sealing strip 45 is integrally attached along a score line to the top edge of panel 44. Two weakening lines 56 cross panel 44 and sealing strip 45, thereby defining a central portion 53. In order to erect this blank into a carton, a sleeve is first formed whereby extension 55 is folded over by 180° towards extension 50 in such a way that cut-outs 51 coincide and both extensions are glued together. Subsequently, the sleeve is formed by folding sealing strip 45 over and against the outside bottom edge of front panel 41. The adhesive is of the kind which is releasable upon traction and is applied to about the ⅔ of sealing strip 45 adjacent panel 44, along hatched part 59. At the filling station, the thus formed sleeve is erected to form a rectangle of which the bottom consists of flaps 47*a* and 49*a* which are folded inwards horizontally and subsequently covered by flaps 46*a* and 48*a* which are glued on in a conventional manner. This carton is filled with product. After filling, flaps 47*b* and 49*b* are folded inwards horizontally and flaps 46*b* and 48*b*** are glued on top in any conventional way used to close cartons.

Figure 9:
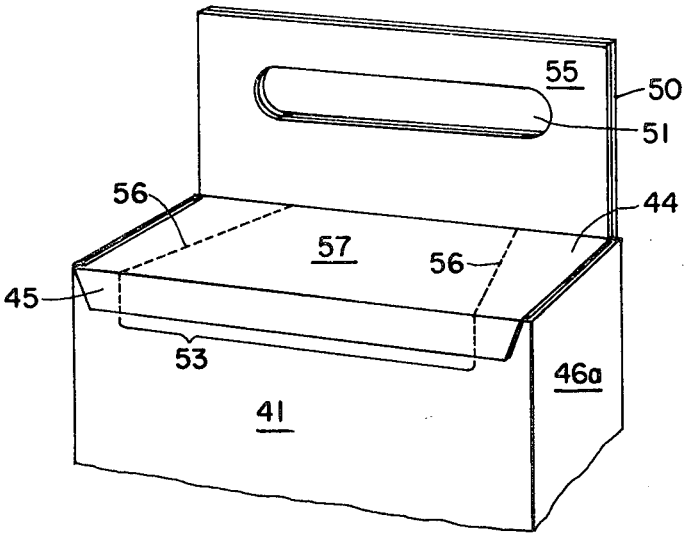
FIG. 9 is a perspective view of the top part of the version of the reclosable carry-carton of FIG. 8 in its erected and closed position after the carton has been filled.

The partial carton illustrated in FIG. 9 shows the carton blank of FIG. 8 in its erected and closed position, as explained in the previous paragraph. Opening of the carton can be easily achieved by exerting an upwards traction on the part without adhesive of sealing strip 45, causing the glue to release, and the weakening lines 56 in sealing strip 45 and top panel 44 to rupture.

Figure 10:
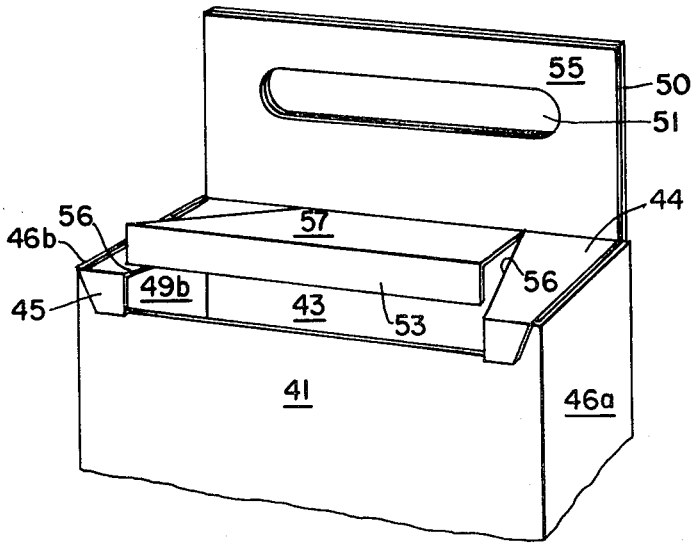
FIG. 10 is a perspective view showing the carton illustrated in FIG. 9 in its reclosing function after having been opened.

The partial carry-carton illustrated in FIG. 10 shows the carton of FIG. 9 being reclosed after having been opened as explained in the previous paragraph. In order to reclose the carton, it is sufficient to tuck portion 53 of sealing strip 45 against the inside of front panel 41. This will ensure that the carton remains closed, even when carried by its integrated handle, since the traction is exerted on only the central portion 57 of panel 44, which traction is compensated by the portion 59 of the sealing strip 45 resting against the inside of front panel 41.

It will be evident to those skilled in the art that, wherever a releasable adhesive (embodiments 2 and 3) or a slight glue line (embodiment 1) are used, this could be replaced by a pattern, partially pre-cut in the panel or flap against which the to be detached flap or extension is glued, which would rupture upon traction.

I claim:

1. A seal-end carton in the form of a sleeve of rectangular cross-section and having alternating face and side panels, said carton provided with an easily opened reclosable end closure with an integrated handle, said end closure comprising two inner top flaps articulated from said side panels along integral score lines and having lines of weakness formed adjacent said score lines across substantially the entire width of said inner top flaps, an upright back top flap extending upwardly from one of said face panels and having a hand hold cut-out therein, an outer top flap articulated from the other of said face panels along an integral score line and having its inner surface adhesively attached to the outer surfaces of said inner top flaps, an extension flap articulated from the distal edge of said outer top flap along a second integral score line and having a cut-out therein corresponding to the hand hold cut-out of said upright back top flap, said extension flap being bent back along said second score line and adhesively joined to said upright back top flap with the hand hold cut-outs in registry, and a tear strip extending substantially across the full width of said extension flap intermediate the hand hold cut-out and said second score line and spaced from said second score line, whereby removal of said tear strip permits access to the carton interior by tearing open said top flaps along said lines of weakness of said inner top flaps while leaving a portion of said extension flap articulated from said outer top flap for reclosure of the carton.

2. The seal-end carton of claim 1 wherein a sift-proof seal of said end closure is obtained by gluing the extension flap to the upright back top flap along a glue line extending across the full width of said extension flap contiguous said second score line.

* * * * *